US006106333A

United States Patent [19]

Purdy

[11] Patent Number: 6,106,333

[45] Date of Patent: Aug. 22, 2000

[54] COAXIAL CABLE CONNECTOR

[76] Inventor: Eric J. Purdy, 144 County Rte. 23 A, Constantia, N.Y. 13044

[21] Appl. No.: 09/345,041

[22] Filed: Jun. 30, 1999

Related U.S. Application Data

[60] Provisional application No. 60/091,331, Jun. 30, 1998.

[51] Int. Cl.[7] ..... H01R 9/05

[52] U.S. Cl. ..... 439/578; 439/638; 439/582

[58] Field of Search ..... 439/578, 582, 439/583, 584, 585, 638, 579

[56] References Cited

U.S. PATENT DOCUMENTS

| | | | |
|---|---|---|---|
| 2,238,834 | 4/1941 | Travers | 439/582 |
| 2,813,144 | 11/1957 | Valach . | |
| 3,836,946 | 9/1974 | Geiger . | |
| 4,360,244 | 11/1982 | Forney, Jr. et al. . | |
| 4,655,534 | 4/1987 | Stursa . | |
| 4,932,898 | 6/1990 | Goodman et al. . | |
| 5,037,329 | 8/1991 | Wright . | |
| 5,088,936 | 2/1992 | Wang . | |
| 5,131,868 | 7/1992 | Forterre . | |
| 5,226,838 | 7/1993 | Hsu . | |
| 5,417,588 | 5/1995 | Olson et al. . | |
| 5,511,995 | 4/1996 | Cheng | 439/638 |
| 5,597,323 | 1/1997 | Resnick et al. . | |
| 5,672,079 | 9/1997 | Leppert et al. . | |

FOREIGN PATENT DOCUMENTS 2 675 640 10/1992 France .

*Primary Examiner*—Paula Bradley
*Assistant Examiner*—Tho D. Ta
*Attorney, Agent, or Firm*—Alston & Bird LLP

[57] ABSTRACT

A connector for making a non-linear connection between a female-type electrical receptacle and a coaxial cable having a male pin-type end connector includes a body defining an internal cavity therein and defining first and second passages that extend into the cavity. The cavity is elongate and defines a longitudinal axis along which an elongate conductor is disposed in the cavity, the conductor having a pin-receiving hole aligned with the first passage such that a pin-type end connector inserted into the first passage can engage the hole in the conductor. The conductor has a portion that extends through the second passage and projects out from the body and defines a pin for insertion into a female-type receptacle.

11 Claims, 4 Drawing Sheets

COAXIAL CABLE CONNECTOR

CROSS-REFERENCE TO RELATED APLICATION

The present application claims the benefit of commonly owned U.S. Provisional Patent Application Ser. No. 60/091,331 filed Jun. 30, 1998.

FIELD OF THE INVENTION

The present invention relates to connectors for establishing electrical connections between coaxial cables or between one coaxial cable and another electrical device.

BACKGROUND OF THE INVENTION

Coaxial cables are widely used for electrical signal transmission. In some applications, a connection must be established between two or more coaxial cables, or between one coaxial cable and another electrical device such as a jack, outlet, or the like, which are more or less in fixed positions relative to each other and are oriented at an angle to each other such that a straight-line or linear connection cannot be made between the cables or between the cable and the device. In these circumstances, the standard male pin-type and female type connectors which are adapted for making straight-line connections cannot be used. What is needed is a device for making an angled or nonlinear connection between two coaxial cables or between one coaxial cable and another electrical device.

Various devices have been proposed for making right-angle and other angled connections between two coaxial cables. Most of the commercially available connectors are relatively complex in construction, and many of them require the user to make a soldered or screw-type connection to the cable conductor and thus are somewhat inconvenient in use where cables must frequently be disconnected and reconnected to the device.

SUMMARY OF THE INVENTION

The present invention provides a connector for making a nonlinear connection between two coaxial cables or between one coaxial cable and another electrical device which is relatively simple in construction and which provides the ability of readily disconnecting and reconnecting cables to the connector without the user having to make a soldered or screw-type connection.

In one embodiment, the connector is designed to make a nonlinear connection between a female-type electrical receptacle and a coaxial cable having a male pin-type end connector. The connector comprises a body defining an internal cavity therein, the cavity defining a longitudinal axis, the body having first and second passages which extend thereinto and open into the cavity. At least the first passage defines an axis which is angled relative to the longitudinal axis of the cavity, the first passage being adapted to receive a pin of the male pin-type end connector. An elongate conductor is mounted in the cavity and extends longitudinally therein. The conductor has a pin-receiving hole extending generally transversely into a first portion thereof. The conductor is mounted with the pin-receiving hole aligned with the first passage such that the pin-receiving hole is capable of receiving the pin of the male pin-type end connector. The conductor has a second portion which extends through the second passage and projects outwardly from the body, the second portion defining a pin adapted to be received by the female-type electrical receptacle.

Advantageously, the first passage is angled about 30°–150° relative to the second passage.

Thus, the connector includes a relatively small number of components, and connections are made between the cables and the conductor without the user having to solder, screw, or otherwise perform additional operations. The user simply inserts the male pin-type cable end connector of the coaxial cable into the first passage to engage the pin with the hole in the first portion of the conductor, and then inserts the second pin portion of the conductor into the female-type electrical receptacle.

The conductor preferably comprises a generally cylindrical member and the pin-receiving hole comprises a hole extending generally transversely therethrough. More preferably, the first portion of the conductor comprises an end portion thereof, and the end portion is split lengthwise so as to define a pair of opposing portions of the conductor. The pin-receiving hole is defined between the opposing portions, and the conductor is formed of a resilient material such that insertion of a pin of a male-type end connector into the pin-receiving hole causes the opposing portions to be spread apart so that the pin is frictionally gripped by the conductor. Accordingly, a reliable electrical connection is established by frictional engagement of the pin in the hole of the conductor.

In accordance with an alternative embodiment of the invention, the conductor comprises a tubular member and the pin-receiving hole extends generally transversely at least partially therethrough.

In accordance with yet another embodiment of the invention, the first portion of the conductor is tubular defining a central bore therethrough, and the first portion of the conductor is angled relative to the second portion such that the central bore is aligned with the first passage in the body. The central bore is adapted to receive the pin of the male pin-type end connector. The end portion of the first tubular portion of the conductor advantageously is split lengthwise to facilitate frictional gripping of the pin as described above.

The invention in another embodiment provides a connector for establishing a nonlinear connection between two coaxial cables each having a male pin-type end connector. The connector comprises a body defining an internal cavity therein, the cavity defining a longitudinal axis, the body having first and second passages which extend thereinto and open into the cavity. Each of the first and second passages defines an axis which is angled relative to the longitudinal axis of the cavity and each passage is adapted to receive a pin of one of the male pin-type end connectors. An elongate conductor is mounted in the cavity and extends longitudinally therein, the conductor having first and second spaced-apart pin-receiving holes extending generally transversely into the conductor. The conductor is mounted with the first and second pin-receiving holes aligned with the first and second passages, respectively, such that the pin-receiving holes are capable of receiving the pins of the male pin-type end connectors. Advantageously, the first and second passages define a turning angle therebetween which is about 130°–180°.

In accordance with a preferred embodiment of the invention, the conductor comprises a generally cylindrical member and the pin-receiving holes comprise holes extending generally transversely therethrough. Advantageously, the first and second portions of the conductor comprise opposite end portions thereof, and the end portions are split lengthwise so as to define a pair of opposing portions of the conductor at each end portion. Each pin-receiving hole is defined between the opposing portions of the respective end portion, and the conductor is formed of a resilient material such that insertion of a pin of a male pin-type end connector into each of the pin-receiving holes causes the opposing portions to be spread apart so that the pin is frictionally gripped by the conductor.

BRIEF DESCRIPTION OF THE DRAWINGS

The above and other objects, features, and advantages of the invention will become more apparent from the following description of certain preferred embodiments thereof, when taken in conjunction with the accompanying drawings, in which.

DETAILED DESCRIPTION OF THE DRAWINGS

The invention is now explained by reference to certain preferred embodiments thereof. It will be understood, however, that the invention is not limited to the illustrated and described embodiments.

Figure 1:
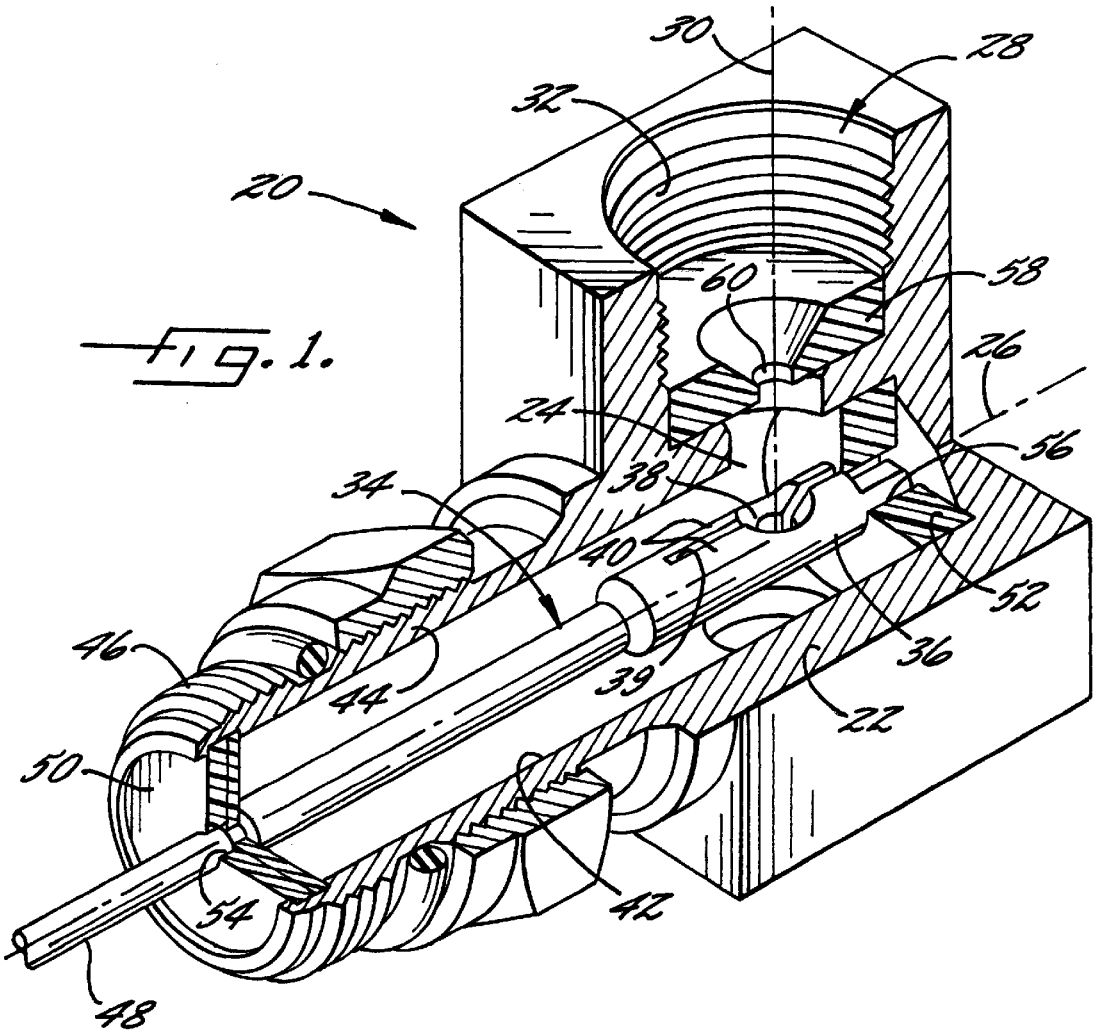
FIG. 1 is a perspective view of a 90° connector in accordance with one preferred embodiment of the invention, partially cut away to show the conductor mounted in the body.

With reference to FIG. 1, a connector 20 in accordance with a first preferred embodiment of the invention is shown. The connector 20 is suitable for making a 90° connection between two coaxial cables where one of the cables has a male pin-type end connector and the other cable has a female-type end connector of the standard type widely used in the industry. Alternatively, the connector can be used to make a connection between one coaxial cable having a male pin-type end connector and any type of female electrical receptacle such as a jack or the like. The connector 20 includes a body 22 which defines an internal cavity 24 therein. The cavity 24 in the preferred embodiment shown in FIG. 1 comprises a generally cylindrical bore, although it will be understood that the cavity can take a variety of forms. The cavity 24 defines a longitudinal axis 26.

The body 22 further includes a first passage 28 which opens into the cavity 24 and extends along a direction defined by an axis 30 which is angled relative to the longitudinal axis 26. In the preferred embodiment illustrated in FIG. 1, the first passage 28 makes a 90° angle relative to the cavity. However, it will be appreciated that the connector can be made with the first passage oriented in various orientations from about 30°–150° relative to the cavity 24.

The first passage 28 preferably comprises a generally cylindrical passage which includes internal threads 32 for engaging an externally threaded male pin-type coaxial cable end connector (not shown) of the standard type. Thus, when the male pin-type end connector is inserted and threaded into the passage 28, the pin of the end connector will extend along the axis 30 and into the cavity 24.

Figure 2:
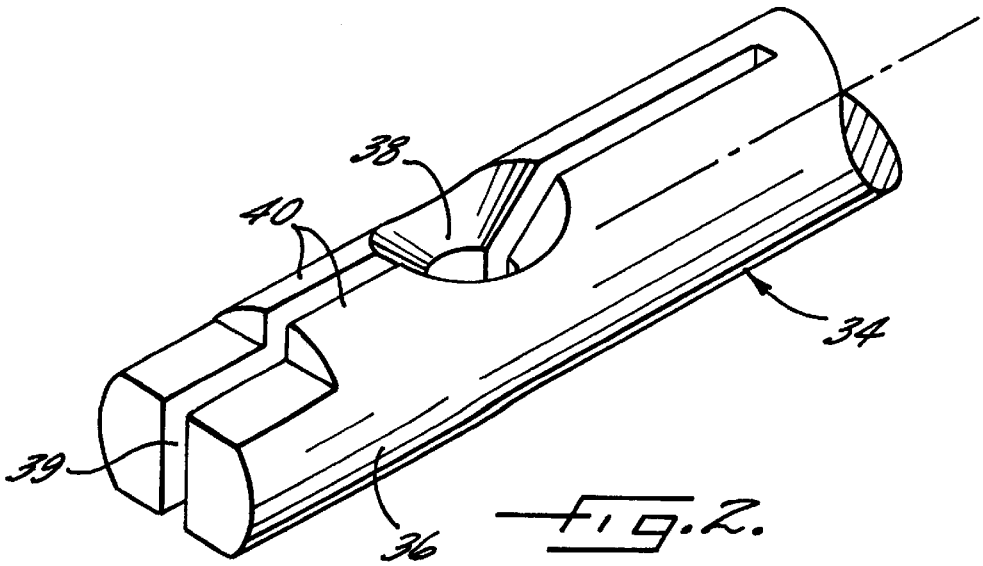
FIG. 2 is a fragmentary perspective view of the conductor of the connector in FIG. 1, showing the split end portion of the conductor.

The connector 20 further includes a conductor 34 which in mounted within the cavity 24 and extends longitudinally therein. The conductor 34 is constructed of an electrically conductive material. Preferably, the conductor 34 is a generally cylindrical member, although it will be understood that the conductor can take a variety of forms. As also shown in FIG. 2, a first end portion 36 of the conductor includes a hole 38 which extends transversely through the conductor. The hole 38 is slightly smaller in diameter than the pin of a male pin-type end connector. A slot 39 is formed lengthwise in the end portion 36 such that the end portion is split lengthwise to form two opposing portions 40 of the conductor. The conductor 34 is mounted in the cavity 24 so that the hole 38 is aligned with the axis 30 of the first passage 28. Accordingly, when a male pin-type end connector is threaded into the first passage 28, the pin of the end connector extends into the cavity 24 and through the pin-receiving hole 38 in the conductor.

Because the pin is slightly larger in diameter than the hole 38, insertion of the pin causes the opposing portions 40 to be spread apart. Preferably, the conductor 34 is made of a material having resiliency such that the spread-apart portions 40 frictionally grip the pin to make a reliable electrical connection between the conductor 34 and the pin.

The body 22 further includes a second passage 42 which in the illustrated embodiment is formed in a tubular connector portion 44 of the body 22. The tubular connector portion 44 has external threads 46 for engaging an internally threaded female-type electrical receptacle (not shown). The second passage 42 is formed coaxially with the cavity 24. The conductor 34 includes a second end portion 48 formed as a pin for engaging the female-type electrical receptacle. The conductor 34 is mounted in the cavity 24 with the second end portion 48 extending through the second passage 42 and outward therefrom so that the end portion or pin 48 projects from the body 22. Thus, a female-type electrical receptacle is threaded onto the connector portion 44 and the pin portion 48 of the conductor 34 engages the female-type receptacle to establish an electrical connection with the conductor 34.

The conductor 34 is affixed in the housing by a pair of dielectric members 50 and 52. The dielectric member 50 is secured within the second passage 42 and includes a hole 54 through which the pin portion 48 of the conductor 34 extends. The dielectric member 52 is secured within the cavity 24 adjacent the first end portion 36 of the conductor and includes a hole 56 which receives the end of the conductor 34. The connector 20 also includes a dielectric guide member 58 mounted within the first passage 28. The guide member 58 includes a central hole 60 for guiding the pin of a male pin-type connector into the pin-receiving hole 38 in the conductor 34.

Figure 3:
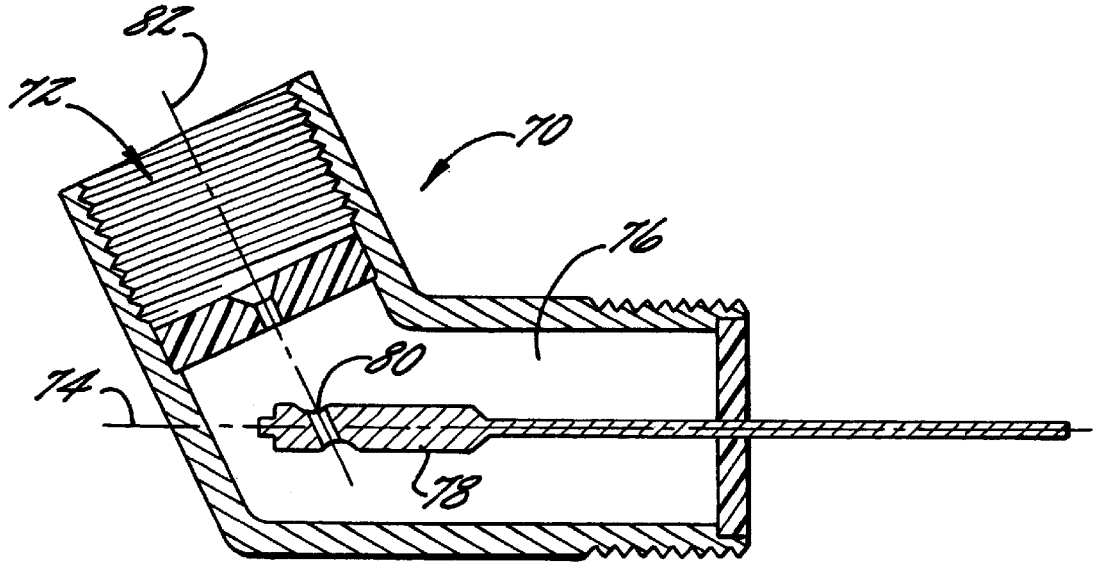
FIG. 3 is a sectioned side elevational view of an alternative embodiment of a connector in accordance with the invention.

The invention is not limited to right-angle connectors. For example, FIG. 3 depicts another embodiment of a connector 70 for making an obtuse-angled connection between a pair of coaxial cables one of which has a male pin-type connector and the other of which has a female-type end connector, or between one coaxial cable having a male pin-type end connector and a female-type electrical receptacle of an electrical device. The connector 70 includes a first passage 72 which is at an obtuse angle with respect to the longitudinal axis 74 of the cavity 76. The conductor 78 includes a pin-receiving hole 80 which is aligned with the axis 82 of the first passage 72. The operation of the connector 70 is essentially the same as that of the connector 20 as described above.

Figure 4:
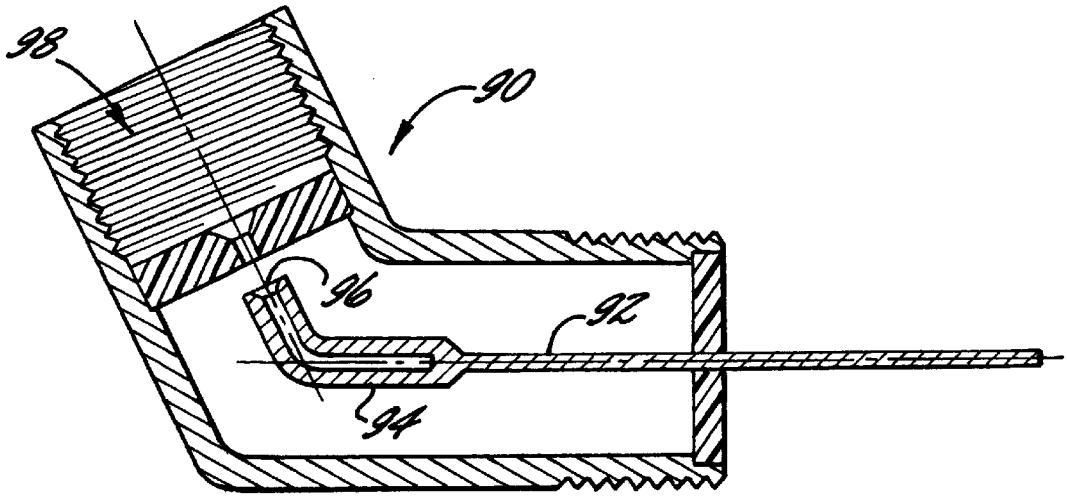
FIG. 4 is a sectioned side elevational view of yet another embodiment of the invention.

It will also be understood that the invention is not limited to one particular type of conductor. For instance, FIG. 4 depicts a connector 90 in accordance with yet another embodiment of the invention, in which the conductor 92 includes a first portion 94 that is tubular. The tubular first portion 94 is bent such that the central bore 96 thereof is aligned with the axis of the first passage 98 for receiving the pin of a male pin-type end connector.

Various other conductor configurations can be used with the present invention. FIGS. 5–9 depict a number of illustrative conductor configurations which can be used.

Figure 5:
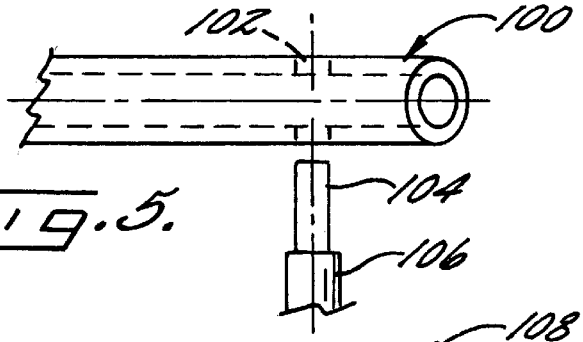
FIG. 5 is a side elevational view of another embodiment of a conductor in accordance with the invention, showing a pin connector being inserted into a hole in the conductor.
Figure 6:
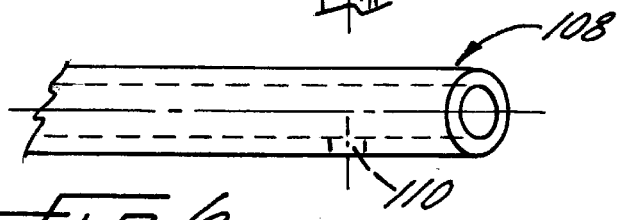
FIG. 6 is a side elevational view of another embodiment of a conductor in accordance with the invention.

FIG. 5 shows a conductor 100 of tubular form having a transverse pin-receiving hole 102 therethrough for receiving a pin 104 of a pin-type connector 106. FIG. 6 shows a conductor 108 similar to that of FIG. 5, except that the pin-receiving hole 110 extends through only one of the side walls of the conductor.

Figure 7:
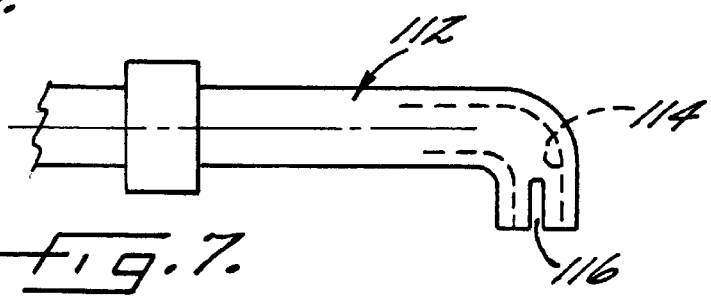
FIG. 7 is a side elevational view of a further embodiment of a conductor in accordance with the invention.

FIG. 7 depicts a conductor 112 of tubular form having the end portion bent so as to align the central bore 114 of the conductor with a pin of a male pin-type end connector. The end of the conductor 112 is split lengthwise by a slot 116 to provide frictional gripping of the pin, similar to the conductor 34 described in connection with FIGS. 1–2.

Figure 8:
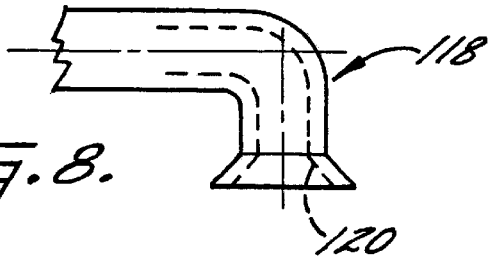
FIG. 8 is a side elevational view of a still further embodiment of a conductor in accordance with the invention.

FIG. 8 shows a conductor 118 of tubular form similar to that of FIG. 7, except that the end of the conductor is flared to form an entrance region 120 to make it easier to guide and insert a pin into the conductor.

Figure 9:
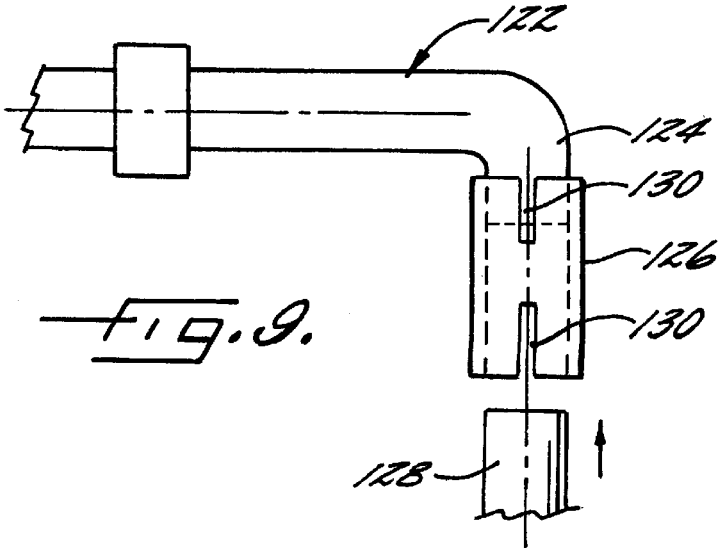
FIG. 9 is a side elevational view of another embodiment of a conductor in accordance with the invention.

FIG. 9 depicts a conductor 122 having an end portion 124 that is bent at an angle to the remainder of the conductor. One end of a connecting member 126 of tubular form is sleeved over the end portion 124, and the other end of the connecting member 126 receives the pin 128 of a pin-type end connector. The opposite ends of the connecting member 126 preferably include slots 130 to facilitate frictional gripping of the end portion 124 and pin 128 as previously described.

Figure 10:
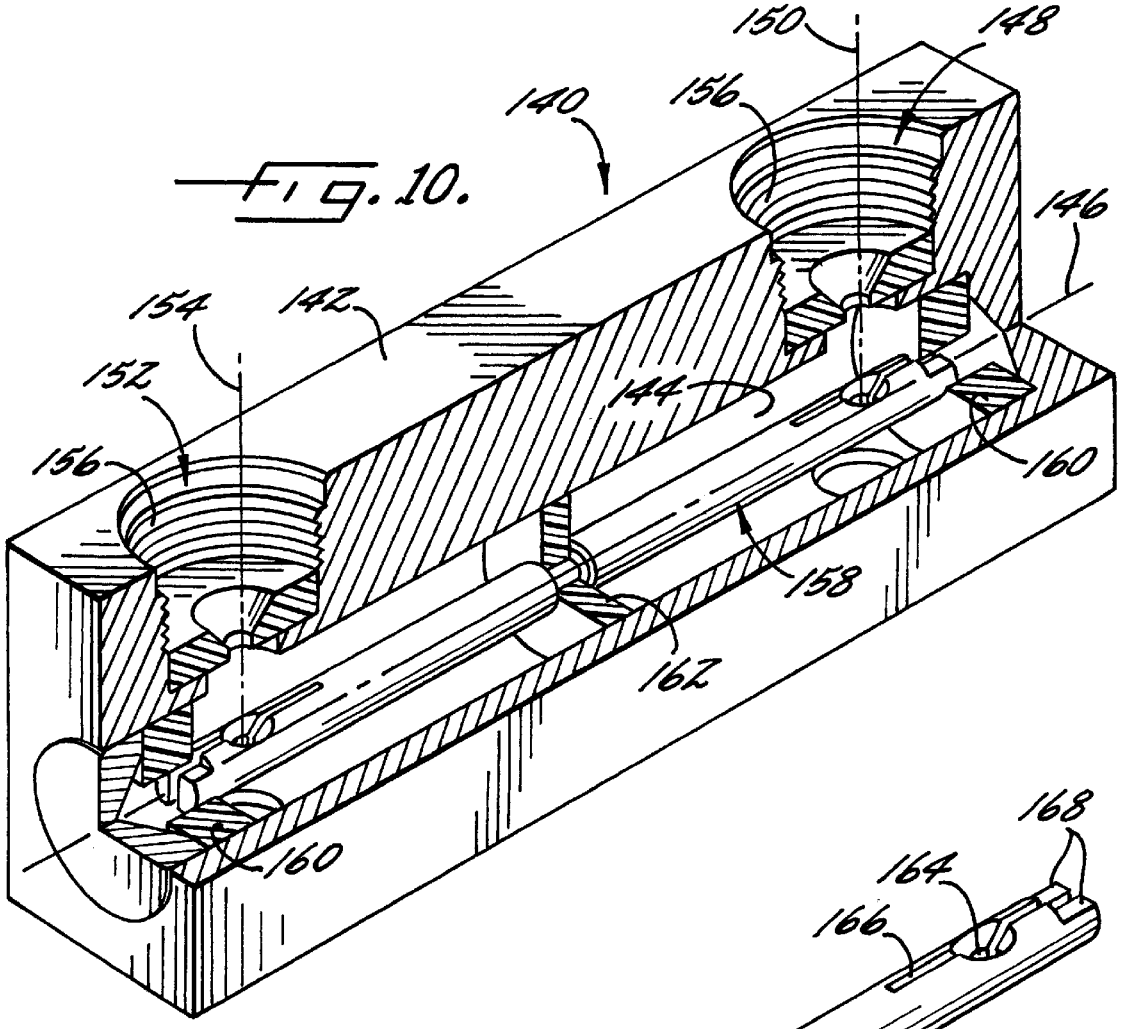
FIG. 10 is a perspective view of a 180° connector in accordance with another embodiment of the invention, partially cut away to show the conductor mounted in the body.
Figure 11:
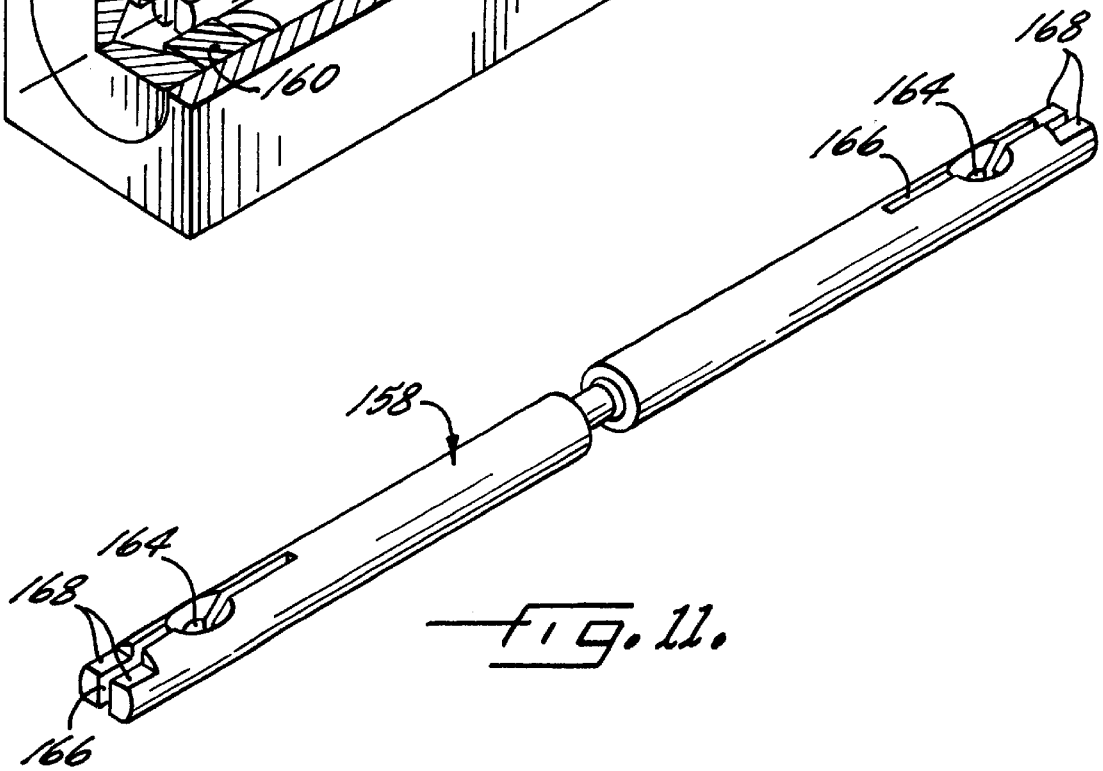
FIG. 11 is a perspective view of the conductor of the connector in FIG. 10.

The invention also includes connectors for making 180° and other large-angle connections between two coaxial cables. FIG. 10 depicts a connector 140 for making a 180° connection between two coaxial cables both of which have a male pin-type end connector. The connector 140 includes a body 142 which defines an internal cavity 144 therein. The cavity 144 preferably comprises a generally cylindrical bore having a longitudinal axis 146. A first passage 148 extends into the body 142 and opens into the cavity, the axis 150 of the first passage 148 being at a 90° angle to the longitudinal axis 146 of the cavity. A second passage 152 spaced from the first passage extends into the body 142 and opens into the cavity 144, with the axis 154 of the second passage being at a 90° angle to the longitudinal axis 146. Each of the passages 148 and 152 includes internal threads 156 for engaging an externally threaded male pin-type end connector of a pair of coaxial cables.

A conductor 158 is mounted in the cavity 144. The conductor 158 is preferably a generally cylindrical member and is affixed in the cavity by a pair of dielectric members 160 which engage the opposite ends of the conductor, and by a third dielectric member 162 through which the conductor extends and which is positioned at about the middle of the conductor. Each of the opposite end portions of the conductor 158 includes a transverse pin-receiving hole 164 which preferably is slightly smaller in diameter than the pin of a male pin-type end connector. The end portions of the conductor 158 preferably are split lengthwise by slots 166 so that each end portion includes a pair of opposing portions 168 which are spread apart by insertion of a pin into the pin-receiving hole 164 such that the pin is frictionally gripped, as previously described.

It will be appreciated that although the connector 140 is described and illustrated as being a 180° connector for making a connection between two cables that are parallel, the connector can alternatively be configured for making connection between non-parallel cables. Advantageously, the connector can be configured such that the first and second passages 148 and 152 define a turning angle therebetween which is about 130°–180°.

The invention thus provides connectors of relatively simple construction for making nonlinear connections between two coaxial cables. The connectors are simple to operate because they do not require the user perform any additional soldering, screwing, or other steps to establish an electrical connection between the cable end connector and the conductor member of the connector.

While the invention has been described by reference to a number of preferred embodiments thereof, it is to be understood that the invention is not limited to these embodiments. Various modifications and/or substitutions of equivalents can be made without departing from the scope of the invention as set forth in the appended claims.

What is claimed is:

1. A coaxial cable connector for establishing a nonlinear connection between a female-type electrical receptacle and a coaxial cable having a male pin-type end connector, comprising:

a body defining an internal cavity therein, the cavity defining a longitudinal axis, the body having first and second passages which extend thereinto and open into the cavity, at least the first passage defining an axis which is angled relative to the longitudinal axis of the cavity, the first passage being structured and arranged to receive a pin of the male pin-type end connector; and an elongate conductor mounted in the cavity and extending longitudinally therein, the conductor having a pin-receiving hole extending generally transversely into a first portion thereof, the pin-receiving hole being aligned with the first passage and being structured and arranged to receive the pin of the male pin-type end connector, the conductor having a second portion which extends through the second passage and projects beyond from the body in the longitudinal axis, the second portion defining an end in the form of a pin adapted to be received by the female-type electrical receptacle, and the conductor extending in one-piece construction from the pin-receiving hole to the end of the conductor.

2. The connector of claim 1, wherein the conductor comprises a generally cylindrical member and the pin-receiving hole comprises a hole extending generally transversely therethrough.

3. The connector of claim 2, wherein the first portion of the conductor comprises an end portion thereof, wherein the end portion is split lengthwise so as to define a pair of opposing portions of the conductor, the pin-receiving hole being defined between the opposing portions, and wherein the conductor is formed of a resilient material such that insertion of a pin of a male-type end connector into the pin-receiving hole causes the opposing portions to be spread apart so that the pin is frictionally gripped by the conductor.

4. The connector of claim 2, wherein the conductor comprises a tubular member and the pin-receiving hole extends generally transversely at least partially therethrough.

5. The connector of claim 1, wherein the first passage is angled about 30°–150° relative to the second passage.

6. The connector of claim 5, wherein the first portion of the conductor is tubular defining a central bore therethrough, the first portion of the conductor being angled relative to the second portion such that the central bore is aligned with the first passage in the body, the central bore being adapted to receive the pin of the male pin-type end connector.

7. A connector for establishing a nonlinear connection between two electrical devices each having a male pin-type end connector, comprising:

a body defining an internal cavity therein, the cavity defining a longitudinal axis, the body having first and second passages which extend thereinto and open into the cavity, each of the first and second passages defining an axis which is angled relative to the longitudinal axis of the cavity and each passage being structured and arranged to receive a pin of one of the male pin-type end connectors; and an elongate conductor mounted in the cavity and extending longitudinally therein, the conductor having first and second spaced-apart pin-receiving holes extending generally transversely into the conductor, the conductor being mounted with the first and second pin-receiving holes aligned with the first and second passages, respectively, such that the pin-receiving holes frictionally receive the pins of the male pin-type end connectors when said pins are inserted into the first and second passages.

8. The connector of claim 7, wherein the first and second passages define a turning angle therebetween which is about 130°–180°.

9. The connector of claim 7, wherein the conductor comprises a generally cylindrical member and the pin-receiving holes comprise holes expanding generally transversely therethrough.

10. The connector of claim 9, wherein the first and second portions of the conductor comprise opposite end portions thereof, wherein the end portions are split lengthwise so as to define a pair of opposing portions of the conductor at each end portion, each pin-receiving hole being defined between the opposing portions of the respective end portion, and wherein the conductor is formed of a resilient material such that insertion of a pin of a male pin-type end connector into each of the pin-receiving holes causes the opposing portions to be spread apart so that the pin is frictionally gripped by the conductor.

11. The connector of claim 9, wherein the conductor comprises a tubular member and the pin-receiving hole extends generally transversely at least partially therethrough.

* * * * *

UNITED STATES PATENT AND TRADEMARK OFFICE

CERTIFICATE OF CORRECTION

PATENT NO. : 6,106,333
DATED : August 22, 2000
INVENTOR(S) : Eric J. Purdy

It is certified that error appears in the above-identified patent and that said Letters Patent is hereby corrected as shown below:

Title page, item [73] Assignee: insert – John Mezzalingua Associates, Inc., East Syracuse, New York--.

Signed and Sealed this

Sixth Day of February, 2001

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,106,333
DATED : August 22, 2000
INVENTOR(S) : Purdy

It is certified that error appears in the above-identified patent and that said Letters Patent is hereby corrected as shown below:

Column 6,
Line 58, cancel "from."

Signed and Sealed this

Thirtieth Day of October, 2001

*Attest:*

Nicholas P. Godici

NICHOLAS P. GODICI
*Acting Director of the United States Patent and Trademark Office*

*Attesting Officer*